US005129289A

United States Patent [19]

Boland et al.

[11] Patent Number: 5,129,289

[45] Date of Patent: Jul. 14, 1992

[54] SHAVING RAZORS

[75] Inventors: Ross F. Boland, West Hartford; Carl A. Hultman, Derby; William E. Vreeland, Shelton; Peter S. Williams, Stratford, all of Conn.

[73] Assignee: Warner-Lambert Company, Morris Plains, N.J.

[21] Appl. No.: 798,377

[22] Filed: Nov. 26, 1991

Related U.S. Application Data

[60] Division of Ser. No. 586,472, Sep. 21, 1990, Pat. No. 5,088,202, which is a continuation of Ser. No. 218,637, Jul. 13, 1988, abandoned.

[51] Int. Cl.[5] ..... B21K 11/00

[52] U.S. Cl. ..... 76/104.1; 30/346.54; 76/DIG. 8; 427/248.1

[58] Field of Search ..... 30/346.54, 350; 76/101.1, 104.1, DIG. 8; 427/248.1, 405, 409, 230

[56] References Cited

U.S. PATENT DOCUMENTS

| | | | |
|---|---|---|---|
| 3,518,110 | 6/1970 | Fischbein | 117/93.4 |
| 3,835,537 | 9/1974 | Sastri | 30/346.53 |
| 3,871,836 | 3/1975 | Polk et al. | 29/194 |
| 4,330,576 | 5/1982 | Dodd | 76/DIG. 8 X |
| 4,716,083 | 12/1987 | Eichen et al. | 428/457 |

*Primary Examiner*—Douglas D. Watts
*Attorney, Agent, or Firm*—Richard S. Bullitt

[57] ABSTRACT

A shaving razor has a blade provided with a sputtered hard coating of the boron carbide and with a fluoropolymer lubricant coating overlying the boron carbide coating and adhering directly thereto. The razor provides good durability and good shave performance.

4 Claims, 1 Drawing Sheet

SHAVING RAZORS

This is a divisional of copending application Ser. No. 07/586,472 filed on Sep. 21, 1990 now U.S. Pat. No. 5,088,202 which was a continuation of Ser. No. 218,637 filed Jul. 13, 1988 now abandoned.

BACKGROUND OF THE INVENTION

The present invention relates to razors.

As referred to in this disclosure, a "razor" is defined as a self-contained shaving unit having at least one blade, a blade support, a guard surface attached to the blade support and extending outwardly from the support below the blade or blades, and a cap covering and protecting the blade or blades. The support and cap combine to maintain the blade or blades in a predetermined shaving position. The razor can include a disposable handle to provide a disposable razor per se or it may be in the form of a disposable cartridge for use with a permanent handle. In both instances the disposable cartridge and the razor head of the disposable razor are substantially identical.

The blades utilized in modern shaving razors incorporate a plurality of features which coact to provide efficient and comfortable shaving action. A shaving razor blade is far sharper than an ordinary industrial razor blade or knife. Sharpness can be expressed and measured in terms of the "ultimate tip radius". Shaving razor blades ordinarily have ultimate tip radii of about 600 Angstroms or less, whereas industrial razor blades, cutting knives and the like ordinarily have ultimate tip radii of several thousand Angstroms. Moreover, modern shaving razor blades have lubricant coatings, such as coatings of fluorocarbon polymers on their cutting edges. The lubricant decreases the frictional forces created by engagement of the blade with the individual whiskers, and hence materially reduces the drag or "pull" experienced by the user upon shaving.

To be considered satisfactory by modern standards, a shaving razor blade should remain usable for many shaves. The blade should retain a keen edge and should retain its lubricant during these repeated shaves, despite exposure to the physical effects of contact with the beard and skin, and despite exposure to the chemical effects of water, soaps and the like encountered in the shaving environment. The shaving razor blade must be adapted for efficient and economical mass production. It must withstand shipment, storage and handling under ordinary conditions without special care. All of these factors together create a formidable technical challenge.

Typical modern shaving razor blades incorporate a substrate of stainless steel, such as an iron and chromium-containing martensitic stainless steel, together with a hard coating of chromium or chromium nitride overlying the stainless steel substrate at least along the cutting edge of the blade. A coating of a fluoropolymer lubricant such as polytetrafluoroethylene overlies the hard coating and adheres thereto. The hard coating may be on the order of a few hundred Angstroms thick.

The hard coating is applied by a process known as sputtering. As further discussed hereinbelow, sputtering ordinarily is conducted under a controlled atmosphere, typically a noble gas at extremely low pressures. Following the sputtering process, the semifinished blades, with the hard coating thereon, are removed from the controlled atmosphere. The blades are coated with the lubricant by applying a dispersion of the fluorocarbon polymer in a fugitive liquid solvent, evaporating off the solvent and then fusing the remaining lubricant by heating to above the melting point of the polymer. Although the fusing step typically is conducted in an inert atmosphere, the blades are exposed to ordinary room air during application of the lubricant dispersion, and during any storage period between application of the hard coating and application of the lubricant dispersion.

Razors incorporating blades according to this general construction have been regarded heretofore as superior in that they provide a good combination of shaving performance, durability and low cost. Nonetheless, there have been needs for still further improvements.

One avenue of research in the razor art has been directed toward the development of a hard coating which could be used as a substitute for chromium in the blade. Ordinary cutting tools become dull and unusable due to gradual abrasive wear of their cutting edges. Resistance to this type of wear typically is related directly to hardness. There are many materials harder than chromium. In theory, any such hard material might be a candidate for experimentation. However, shaving razor blade cutting edges normally do not become dull due to this type of wear. The very sharp, thin edges of shaving razor blades normally become dull due to microscopic fractures of the edge. Therefore, hardness alone does not always correlate well with blade edge durability in a shaving razor blade. Wear resistance results achieved in other applications may not reliably predict blade edge durability in a shaving razor blade. Moreover, a hard coating for use in a shaving razor blade must be compatible with the lubricant coating and with the processes used to apply the lubricant. In particular, the lubricant must adhereto the hard coating to provide a durable lubricating effect in use. Adhesion between hard coating materials and lubricants is not predictable. Many otherwise suitable hard coating materials are incompatible with lubricants in that the lubricant will not adhere satisfactorily. For these and other reasons, the search for better hard coatings for use in shaving razor blades has not been successful heretofore.

SUMMARY OF THE INVENTION

One aspect of the present invention provides an improved shaving razor. The improved shaving razor according to this aspect of the invention includes an improved blade. The blade includes a substrate and a layer of a hard coating composition overlying the substrate at least at the cutting edge of the blade and defining the ultimate tip of the cutting edge. Most preferably, a polymeric lubricant coating directly overlies the hard coating and adheres thereto.

In a razor according to this aspect of the invention, the hard coating composition includes boron and carbon as boron carbide. Desirably, at least the major portion of the hard coating composition is boron carbide. Pure boron carbide includes 80 atomic percent boron and 20 atomic percent carbon. Thus, the hard coating composition desirably includes at least about 40 atomic percent boron and at least about 10 atomic percent carbon, preferably at least about 60 atomic percent boron and about 15 atomic percent carbon, and more preferably at least about 72 atomic percent boron and about 18 atomic percent carbon. Preferably, the atomic ratio of boron to carbon in the hard coating is between about 3:1 and 4.5:1, preferably between about 3:1 and about 4:1 and most preferably about 4:1.

The hard coating composition may include one or more additional metal or metalloid elements other than boron. A coating incorporating such additional elements desirably consists essentially of carbides of boron and of the additional element or elements. The additional element or elements preferably are selected from the group consisting of Si, Zr, Hf and combinations thereof, Si being particularly preferred. Desirably, any additional metal or metalloid element or elements is present in minor proportion so that the atomic ratio of boron to additional metal or metalloid elements is at least about 5:1, preferably at least about 7:1 and most preferably at least about 9:1. The hard coating preferably is substantially amorphous, i.e., substantially devoid of crystal structure discernable by X-ray crystallography.

The lubricant desirably includes of a fluorinated polyolefin. Lubricants consisting essentially of polytetrafluoroethylene (PTFE) are particularly preferred. The substrate preferably includes a ferrous alloy, such as a stainless steel including iron and chromium. Desirably, the hard coating directly overlies the ferrous alloy and adheres thereto.

The preferred shaving razors according to this aspect of the present invention provide excellent shave performance. This excellent performance persists during prolonged usage. Although the present invention is not limited by any theory of operation, it is believed that this combination of performance characteristics results at least in part from good durability of the cutting edge incorporating the hard coating together with good interaction between the hard coating and the overlying polymeric lubricants. This aspect of the present invention thus incorporates the discovery that boron carbide provides the combination of physical properties and lubricant compatibility which have long been needed. Further aspects of the present invention provide processes for making shaving razors and blades. Processes according to this aspect of the invention desirably include the steps of depositing a layer of the boron carbide coating composition on a substrate cutting edge by sputtering, depositing a polymeric lubricant such as a fluorinated polyolefin on the hard coating layer and heat treating the substrate with the hard coating layer and lubricant thereon at about the melting temperature of the lubricant or above.

These and other objects, features and advantages of the present invention will be more readily apparent from the detailed description of the preferred embodiments set forth hereinbelow taken in conjunction with the accompanying drawings.

DETAILED DESCRIPTION OF THE PREFERRED EMBODIMENTS

A blade according to one embodiment of the present invention includes a flat, striplike substrate 10. The substrate may incorporate substantially any of the materials commonly utilized for conventional razor blades. Of those materials, ferrous metals such as stainless steels, are preferred. Of these, martensitic stainless steels of the type commonly referred to in the trade as "400-Series" are particularly preferred. These steels incorporate at least about 80% Fe and at least about 10% chromium. 440A stainless steel, consisting essentially of about 13 to 15% Cr, about 0.7% C. and the remainder Fe is particularly preferred.

Figure 2:
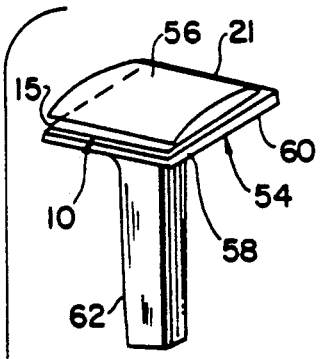
FIG. 2 is a schematic view indicating the steps in a process according to one embodiment of the present invention.
Figure 2:
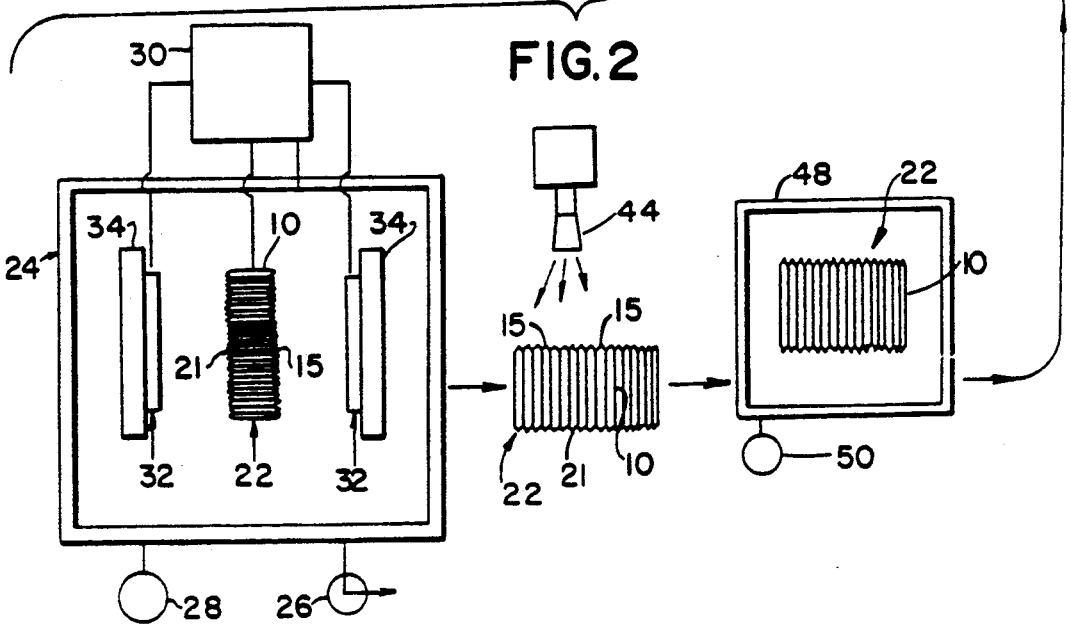

In the conventional manner, a ground facet 11, rough-honed or rear facet 12 and fine-honed or forward facet 14 are provided on one face of a substrate 10 at one cutting edge 15. A fine-honed or forward facet 16, rough-honed or rear facet 18 and ground facet 19 are provided on the opposite face but on the same cutting edge 15 of the substrate. Forward facets 14 and 16 intersect one another at an extremity 20 of the edge. The facets are formed by conventional processes such as grinding, honing and the like. The geometry of the facets may also be conventional, and may be the same as that employed for the facets of a conventional chromium-coated stainless steel razor blade. Typically, the intersecting forward facets of the substrate define an edge radius of no more than about 300 Angstroms. For a double-edge blade, the same arrangement of facets is provide on a second cutting edge 21 (FIG. 2) opposite from the first-mentioned cutting edge 15.

After formation of the facets, the blades are cleaned by a conventional wet cleaning process, which may include washing in appropriate solvent solutions so as to remove debris and grease left as residues from the grinding or honing processes.

Following this preliminary cleaning step, the substrates 10 are subjected to a sputter cleaning step Preferably, the substrates 10 are arranged in a stack 22, with the faceted or cutting edges 15 and 21 of all of the substrates in the stack aligned on the long sides of the stack and extending parallel to one another. The stack is placed within a chamber 24 of the sputtering apparatus. A conventional vacuum pumping device 26 is actuated to bring the chamber to a low, subatmospheric pressure, typically about $10^{-7}$ to $10^{-6}$ mmHg, whereupon a conventional gas supply apparatus 28 is actuated to fill chamber 24 with a noble gas such as argon and to maintain the pressure in the chamber at about $10^{-3}$ to $10^{-2}$ mmHg. A sputtering power supply 30 is then actuated to apply an alternating radio frequency ("RF") potential between the stack of substrates 10 and the chamber ground. Ordinarily, the power density applied may be about 0.1 watts/cm$^2$ to about 1.0 watts/cm$^2$, based on the projected area of the long sides of the stack, i.e., the area of the stack projected in the planes defined by the cutting edges. The alternating potential creates an electrical discharge within the low pressure gas inside chamber 24, thus converting the gas to a plasma or mixture of positively charged ions and the electrons. Due to the well-known "diode effect" of the plasma, the stack of substrates 10 assumes a negative potential with respect to the plasma. Under the influence of this potential, positively charged ions from the plasma bombard the exposed edges 15 and 21 of the substrates. Alternatively, the power supply 30 may be arranged to provide a negative DC potential to the substrates, with or without an alternating or RF potential. A DC potential will likewise cause an electrical discharge and will likewise cause bombardment of the substrates by ions from the plasma. With either DC or RF sputter cleaning, the bombarding ions dislodge material from the surfaces of facets 11–14 and 16–19.

The dislodged material, in the form of highly energetic neutral atoms, passes into the vapor state and passes from the chamber or is deposited on the walls of the chamber. This sputtering action removes trace contaminants from the surfaces of the substrates, particularly at the facets. It is important to continue this sputter cleaning step until the facet surfaces are essentially free of contaminants. In particular, it is desirable to remove in the sputter cleaning step any traces of oxygen remaining at these surfaces. Although stainless steels are ordinarily considered oxidation resistant materials, it should be appreciated that the surface of a stainless steel substrate—the first few atomic layers forming the boundary between the substrate and the surroundings—may incorporate substantial proportions of adsorbed oxygen, iron oxides, chromium oxides or combinations of these if the substrates have been exposed to the ordinary room atmosphere. This sputter cleaning step removes these first few atomic layers and hence removes adsorbed oxygen, oxides and other contaminants. The time required to achieve an acceptable degree of surface cleanliness will vary depending upon the gas pressure, the applied power and the physical configuration of the sputtering apparatus. Typically, at least about five minutes to about fifty minutes or more, and more typically about ten minutes to about thirty minutes will provide substrate facet surfaces essentially free of either uncombined or oxide-form oxygen and essentially free of other contaminants as well.

Following the sputter cleaning step, the substrates 10 are subjected to a sputter coating step. The substrates are maintained in a non-oxidizing atmosphere such as a noble or reducing gas or a high vacuum between these steps. Typically, the sputter coating step is conducted in the same apparatus as employed for the sputter cleaning step, and the sputter coating step is conducted immediately after the sputter cleaning step.

The sputter coating step is also conducted utilizing a noble gas atmosphere such as argon. Preferably, the sputter coating step is performed at between about $10^{-3}$ and $10^{-2}$ mmHg argon pressure, and more preferably at about $4\times10^{-3}$ mmHg argon pressure. In the sputter coating step, targets 32 confront the edges 15 and 21 of the stacked substrates. Each target 32 incorporates the material to be deposited as a hard coating on the substrates. To provide the desired boron carbide containing coating each target 32 preferably consists principally of boron and carbon at an atomic ratio of about 3:1 to about 4.5:1, more preferably between about 3:1 and about 4:1 and most preferably about 4:1. Desirably, the boron and carbon are present in the target as an alloy of boron with carbon, such as boron carbide. The target may also include an additional, non-boron metal or metalloid such as Si, Zr, Hf or combinations thereof. The additional metal or metalloid may be present in the target as a carbide. The additional material in the target may be alloyed with boron and carbon, or else may be present as separate portions of the target.

Each target is retained on a conventional target holder of the type commonly employed in sputtering apparatus. During the sputter coating operation, power supply 30 is actuated to maintain the stack 22 of blades 10 at the ground potential and to apply an RF potential between the targets 32 and the chamber wall. Once again, the applied RF potential creates an electrical discharge in the gas within the chamber so as to convert the gas to a plasma. Under the influence of the diode effect, the targets 32 assume a negative potential with respect to the plasma, so that positively charged ions from the plasma bombard each target and dislodge material therefrom. DC potential may be applied instead of RF potential or in conjunction therewith. Further, the sputtering apparatus and techniques may employ well-known sputtering expedients. For example, a magnetic field may be applied in the vicinity of the target to enhance the sputtering by the well-known magnetron effect. Also, the stack of substrates and/or targets may move relative to one another so as to enhance uniformity of sputtering conditions along the length of each cutting edge.

Figure 1:
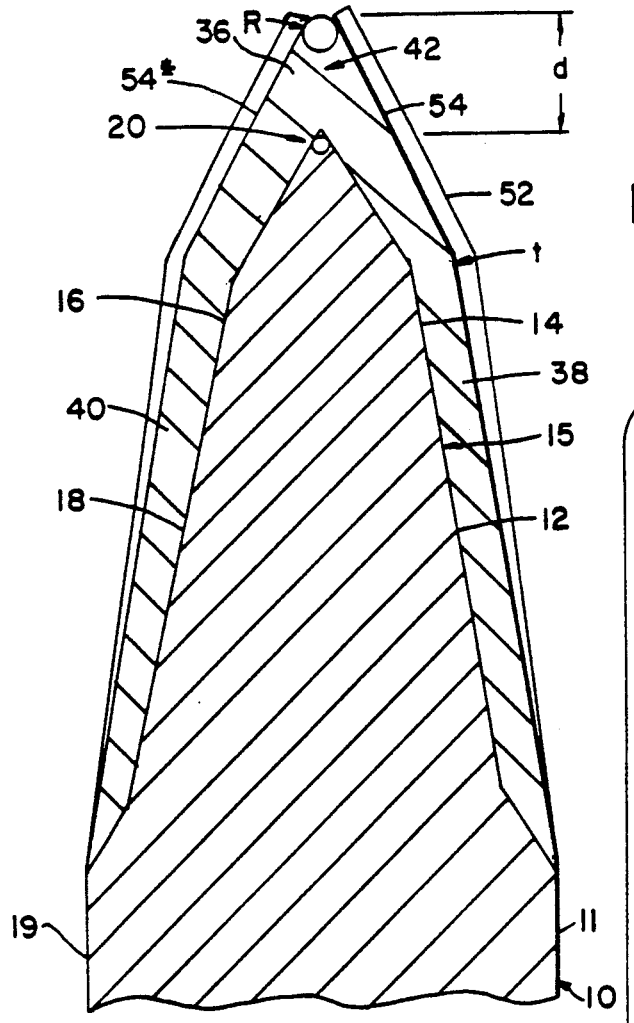
FIG. 1 is a schematic, idealized, fragmentary sectional view of a blade according to one embodiment of the invention.

The material dislodged from targets 32 deposits on substrates 10, and particularly upon the exposed cutting edges 15 and 21 thereof as a coating 36 directly overlying the ferrous material of the substrates and adhering thereto. The material from the target deposits as a substantially homogeneous, amorphous coding. Because the substates 10 are arranged in a stack 22 as shown during the sputter coating step, the sputtered atoms pass generally forwardly-to-rearwardly with respect to each cutting edge of substrate (top to bottom in FIG. 1) before impinging on the substrate. The coating deposits generally in the configuration indicated in FIG. 1. Thus, oppositely facing layers 38 and 40 are deposited on the oppositely directed surfaces of each substrate 10 at edge 15. Layer 38 overlies facets 12 and 14, whereas layer 40 overlies facets 16 and 18. Each layer 38 and 40 projects in a forward direction beyond the extremity of blade 20, so that the two layers merge with one another. The merged layers define the ultimate tip or extremity 42 of the cutting edge. The hard coating on the second cutting edge 21 of each blade is substantially the same.

As used herein with reference to a hard coating layer overlying a substrate surface, the term "thickness" refers to the dimension perpendicular to the plane of the underlying surface. As illustrated, the thickness t of each hard coating layer 38 and 40 decreases progressively in the rearward direction, away from the ultimate tip 42 of the cutting edge. Preferably, the average thickness of each hard coating layer 38 and 40 on the forward facets 14 and 16 closest to the forward extremity 20 of the substrate is between about 100 and about 400 Angstroms, more preferably between about 150 and about 300 Angstroms, and most preferably between about 200 and about 250 Angstroms. The tip to tip dimension or forward to rearward dimension d between the forwardmost extremity 20 of the substrate and the forwardmost extremity 42 of the hard coating desirably is between about 200 and about 900 Angstroms, more preferably between about 300 and about 700 Angstroms, and most preferably between about 500 and about 600 Angstroms. Both the average coating thickness t and the tip to tip distance d increase as the sputter coating process progresses.

The time required to deposit the hard coating material to the desired coating thickness and tip to tip distance will depend upon the geometry of the sputtering apparatus, the gas pressure and the power applied by source 30. The factors governing deposition rate of various materials in sputtering processes in general are well known to those skilled in the sputtering art, and the same factors apply in the present sputter coating step. Merely by way of example, higher sputtering power input tends to produce a higher deposition rate. Under typical conditions however, employing about 1 to about 30, and desirably about 6 watts/cm$^2$ RF sputtering power input based upon the sputtered area of the target 32, the deposition process can be completed in between about 5 minutes and about 50 minutes, typically between about 20 minutes and about 40 minutes and most preferably in about 30 minutes. Sputtering processes which deposit coatings of the preferred thicknesses mentioned above within the preferred times generally do not cause overheating or other adverse effects on the substrates or the coatings.

Provided that the facet surfaces are scrupulously cleaned during the sputter cleaning step, the hard coating will adhere tenaciously to the facet surfaces. Ordinarily, no special sputtering techniques or steps, apart from the thorough sputter cleaning stage, need be employed to enhance this adhesion. As is well known in the sputtering art, adhesion between a coating and the substrates may be enhanced by techniques such as ion implantation, wherein some of the sputtered target material is ionized and accelerated towards the substrate and applied electrically potential, and by application of a negative potential to the substrates during conventional sputtering techniques. These additional techniques however are generally unnecessary.

The semi-finished blades resulting from the sputter coating step, incorporating the substrates with the hard coatings thereon, are removed from the sputtering chamber. A polymeric lubricant is then deposited on the blades, as by contacting the blades with a dispersion of the polymer in a fugitive liquid carrier.

Thus, the dispersion may be sprayed from a conventional spray nozzle 44 onto the exposed cutting edges 15 and 21 of the blades. Dipping or other conventional liquid application techniques may be employed as alternates to spraying. Where the polymer is in powder form, conventional powder application techniques can be used. The polymer deposition step and any storage and handling between hard coating and polymer deposition may be conducted in an ordinary air atmosphere. Following the polymer deposition step, the blades are subjected to heat treatment in a conventional industrial oven 48 arranged with a gas supply apparatus 50. The gas supply apparatus 50 is operated to maintain a non-oxidizing atmosphere such as a reducing or inert atmosphere within the oven during the heat treatment. The heat treatment is conducted at or above the melting temperature of the polymer, and preferably at about the melting temperature of the polymer, for a period sufficient to fuse the lubricant into a coherent lubricant coating 52 overlying the hard coating 36. The thickness of the lubricant coating 52 will depend upon the amount of lubricant applied. Preferably, the amount of lubricant applied is the minimum amount required to form a coherent coating on those portions of the hard coating 36 overlying the forwardmost facets 14 and 16. Although some lubricant may be applied on other areas of the blade, the same is not essential.

The lubricant preferably is a fluorinated polyolefin or a copolymer or blend including the fluorinated polyolefin. Thus, the lubricant desirably includes polymers having a main chain or backbone composed principally of $—CF_2—$ repeating units. The lubricant desirably includes polytetrafluoroethylene ("PTFE"), and most desirably consists essentially of PTFE. The molecular weight of the PTFE desirably is from about 10,000 to about 30,000,000. Relatively low molecular weight PTFE polymers, commonly referred to as the telomers are preferred. PTFE having molecular weight of between about 10,000 and about 50,000, and particularly about 30,000, is especially preferred. One suitable dispersion of a 30,000 molecular weight PTFE in a volatile fluorocarbon solvent is commercially available under the registered trademark VYDAX 1000 from the DuPont Company of Wilmington, Delaware, U.S.A. Other PTFE dispersions are available under the registered trademark Fluon from ICI Chemical Industies of Great Britain. Higher molecular weight PTFE suitable for use in the present process is sold under the registered trademark Teflon by the Dupont Company. As the melting temperature of PTFE is approximately 327° C., temperatures between about 327° C. and about 335° C. are preferred for the heat treatment step when PTFE is employed.

As noted above, the deposited hard coating material defines the ultimate tip of 42 of the cutting edge. The sharpness of the edge at this ultimate tip can be expressed in terms of the ultimate tip radius R, which is the radius of curvature of the hard coating surface at the tip. The ultimate tip radius R normally is measured by use of a scanning electron microscope. The lubricant is not considered in measurement of the ultimate tip radius. As used in this disclosure with reference to a lubricant-coated blade, the term "ultimate tip radius" should be understood as referring to the radius exclusive of the lubricant.

To form a completed razor, the blade 10 is assembled with a blade support 54 and a cap 56 so that the blade 10 is imprisoned between the blade support and cap. The blade support 54 defines a guard surface 58 extending outwardly from the support beneath cutting edge 15 of blade 10, and a further guard surface 60 associated with edge 21. The cap and support may be assembled permanently to the blade, as in a typical disposable razor cartridge, by conventional techniques. Alternatively, the blade may cooperate with a resuable cap and support, as in a conventional "safety razor". Typically, the razor is provided with a handle 62, which may be integral with the blade support or detachably connected thereto.

The finished blades provide particularly desirable performance characteristics. The forces generated during cutting when the blade is new generally are less than those for comparable blades having other hard coating systems. Although the cutting forces increase gradually with repeated usage of the blade, this increase tends to be less for a blade according to the present invention than for comparable blades with conventional chromium hard coatings. These factors demonstrate that the blades according to the present invention retain the sharpness of the cutting edge, and also retain a tenacious bond between the lubricant and the hard coating.

The non-limiting examples set forth below are intended as illustrating certain aspects of the present invention.

EXAMPLE I

440-A stainless steel strip is ground and honed to provide a batch of uncoated semi-finished blades or substrates. The grinding and honing processes are maintained substantially uniform throughout the batch. Two sets of samples are taken from the batch. Both samples are subjected to the same preliminary cleaning or washing steps. Both samples are processed in identical sputtering apparatus. One sample, designated as the control sample, is sputter-cleaned for nine minutes under about $10^{-3}$ mmHg argon pressure and about 0.1 watts/cm$^2$ RF power density. Following this sputter-cleaning operation, the control sample is sputter coated with chromium for 30 minutes under about $10^{-3}$ mmHg argon pressure at about 3.0 watts/cm$^2$ power density. The other sample, designated as the test sample, is subjected to an 18 minute sputter cleaning cycle under about $10^{-3}$ mmHg argon pressure and using about 0.3 watts/cm$^2$ RF power density. Following the sputter cleaning cycle, the test sample is sputter-coated using a target composed of boron carbide under about $10^{-3}$ mmHg argon pressure and about 6.0 watts/cm$^2$ power density.

Following the sputter-coating operations, sub-samples are collected from the control and test samples. These sub-samples, designated as control-unlubricated and test-unlubricated are set aside for later testing. X-ray diffraction and electron micrographic studies of the test samples demonstrate that the coating is essentially amorphous and devoid of grain boundaries. The coating consists of boron and carbon at a 4:1 molar ratio. The remainder of the control sample and the remainder of the test sample are each sprayed with Vydax 1000 fluorpolymer dispersion under identical spraying conditions, and subsequently heat treated at about 327° C. for about 10 minutes under an atmosphere of dry nitrogen. The resulting blades are designated control-lubricated and control-unlubricated.

Individual blades from each of the four groups are subjected to a felt cutter force test. In this test, the force required to advance the cutting edge of the blade through a piece of felt having known physical properties at a predetermined rate is measured. The test is repeated utilizing the same blade with a new piece of felt on each repetition. The results are as indicated in Table I. In each case, the numeric values represent the signal from the apparatus force transducer in millivolts. This signal is proportional to the cutting force.

TABLE I

| SAMPLE | 1st CUT | 5th CUT | 20th CUT | 40TH CUT |
|---|---|---|---|---|
| Control-Unlubricated | 43 | 49 | 65 | 87 |
| Test Unlubricated | 41 | 40 | 42.5 | 42.5 |
| Control Lubricated | 28.4 | 21.5 | 27.3 | Not Tested |
| Test Lubricated | 22.6 | 18.4 | 21.0 | Not Tested |

The results for the control unlubricated samples show the typical pattern of edge degradation for an unlubricated blade. The cutting force progressively increases, at an average rate of about 1 mv per cut. By contrast, the test unlubricated blade has an average increase in cutting force of only about 0.04 mv per cut. This increase is essentially insignificant, and indicates that the hard coating on the test blades, and the ultimate tip defined by the hard coating, is substantially unaffected by repeated exposure to these severe conditions of the felt cutting test.

The results for both groups of lubricated blades show a typical decrease in cutting forces for the first few cuts. Following this decrease, the results for the control sample show a substantial progressive increase, at an average slope of about 0.39 mv per cut from the fifth to the twentieth cut. Although the test samples also show an increase, the average increase is smaller, only about 0.17 mv per cut from the fifth to the twentieth cut. This indicates that the test samples provide adhesion between the hard coating and the lubricant coating at least equal to that provided by the control samples.

EXAMPLE II

The procedure of Example I is repeated, except that the sputtering target for the test group includes about 5 atomic percent silicon, 76 atomic percent boron and 19 atomic percent carbon. The results are substantially the same as those set forth in Example I.

Numerous variations and combinations of the features described above can be employed without departing from the present invention. Merely by way of example, the invention may be applied in connection with a single-edged blade rather than the double-edged blades discussed above. Accordingly, the foregoing description of the preferred embodiment should be understood by way of illustration rather than by way of limitation of the present invention as defined in the claims.

We claim:

1. A method of making a shaving razor comprising the steps of providing a substrate having a cutting edge, depositing at least one layer of a hard coating composition including boron and carbon as boron carbide on said cutting edge of said substrate by sputtering, depositing a polymeric lubricant on said layer of said hard coating composition and heat treating said substrate with said hard coating and lubricant thereon at an elevated termperature at least equal to about the melting temperature of said lubricant so as to fuse said lubricant to said hard coating composition.

2. A method as claimed in claim 1 wherein said hard coating composition includes at least about 40 atomic percent boron and at least about 10 atomic percent carbon.

3. A method as claimed in claim 2 wherein said lubricant includes a fluorinated polyolefin.

4. A method as claimed in claim 2 wherein said step of depositing said polymeric lubricant is conducted in an atmosphere of air.

* * * * *